US008336234B2

(12) United States Patent
Spiro

(10) Patent No.: US 8,336,234 B2
(45) Date of Patent: Dec. 25, 2012

(54) PROMOTIONAL LUGGAGE TAG

(75) Inventor: Steven M. Spiro, Chappaqua, NY (US)

(73) Assignee: Tracer Imaging LLC, White Plains, NY (US)

( * ) Notice: Subject to any disclaimer, the term of this patent is extended or adjusted under 35 U.S.C. 154(b) by 53 days.

(21) Appl. No.: 12/940,720

(22) Filed: Nov. 5, 2010

(65) Prior Publication Data

US 2011/0107629 A1 May 12, 2011

Related U.S. Application Data

(60) Provisional application No. 61/280,926, filed on Nov. 10, 2009.

(51) Int. Cl.
*G09F 3/20* (2006.01)

(52) U.S. Cl. ..... 40/6; 40/674; 40/665; 40/673

(58) Field of Classification Search ..... 40/6, 645, 40/633, 665, 674, 1.5; 428/43
See application file for complete search history.

(56) References Cited

U.S. PATENT DOCUMENTS

| | | | | |
|---|---|---|---|---|
| 2,201,139 | A * | 5/1940 | Ivey | 40/668 |
| 3,775,882 | A * | 12/1973 | Wheeler | 40/645 |
| 6,189,935 | B1 * | 2/2001 | Oberholzer et al. | 283/80 |
| 7,325,347 | B2 * | 2/2008 | Riley | 40/633 |
| 7,373,749 | B1 * | 5/2008 | Lewis | 40/673 |
| 2008/0150174 | A1 * | 6/2008 | Raymond et al. | 264/1.7 |
| 2009/0094872 | A1 * | 4/2009 | Ali et al. | 40/633 |

* cited by examiner

*Primary Examiner* — Lesley D Morris
*Assistant Examiner* — Christopher E Veraa
(74) *Attorney, Agent, or Firm* — Leason Ellis LLP

(57) ABSTRACT

According to one embodiment, a perforated card includes a plurality of separable components that includes a tag suitable for the inclusion of personal data such as an address. The tag includes an opening. The card also includes a strap that is separably attached to at least a portion of the tag. The strap is insertable through the opening of the tag and is configured to be fixedly attached about a handle of a piece of luggage.

20 Claims, 3 Drawing Sheets

PROMOTIONAL LUGGAGE TAG

CROSS REFERENCE TO RELATED APPLICATION

The present application claims the benefit of U.S. patent application Ser. No. 61/280,926, filed Nov. 10, 2009, which is hereby incorporated by reference in its entirety.

TECHNICAL FIELD

The invention relates to tags of the type conventionally used to identify luggage or other personal articles.

SUMMARY

The invention involves the integration the functional components of an attachable luggage tag within a flat card. These components include a strap and a card. The card may electively be devised so that the strap is fully separable from the tag. The strap can be provided with mechanical linking features, so that a reliable attachment can be made about an attachment point such as a luggage handle. The tag and the strap can be compatibly devised so the strap can attach to, mate with, or intrude through an opening formed in the card element. One side of the tag can be provided a surface amenable to the provision of personal information. In a particular embodiment off the invention, all or part of the luggage may be provided with an optically variable pattern, which may serve to assist a traveler in the recognition of the luggage piece.

BRIEF DESCRIPTION OF THE DRAWINGS

A few exemplary embodiments of the invention are depicted in the following figures, in which.

DETAILED DESCRIPTION OF CERTAIN EMBODIMENTS

Figure 1:
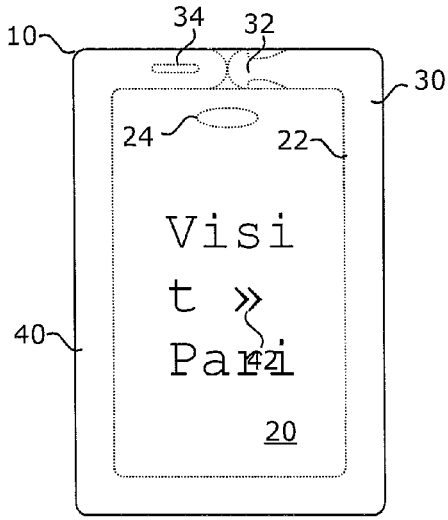
FIG. 1 shows a first view of a lenticular card formed according to the invention.

Many situations call for inexpensive tags using loop fasteners. The range of situations encountered requires varying degrees of security and reversibility. A common practical situation is where an identification tag must be reliably and fixedly attached to a targeted subject, such as piece of luggage. A subset of this type of attachment includes those in which the user desires the freedom to remove and electably reattach the identification device on repeated occasions.

Reversible attachments of this sort are often historically accomplished by the provision of mating features which are resistant to accidental parting, but which may be separated by deliberate intervention by the user. Structural features commonly enlisted to assist in the function include compatible arrangements of slots, loops, serrations, tabs, locks or hooks. The connection process can include one or more specific steps that are unlikely to be reversed by casual handling.

For example, a flexible tab on the end of a strap may need to be deformed to a particular curve in order to be inserted in a compatibly shaped slot. The tab will tend to revert to its relaxed state on passed through the curved slot. Because of the improbability of accidental pressure inducing the requisite curvature, the linkage is durable until the deliberate insertion process is conscientiously reversed.

In another class of fastener, the tension in a deformed material continues to exert pressure which discourages release. In another type of attachment feature, the reliability of the connection depends primarily on the deliberately close tolerances of the inserted part and its compatible opening. In this case, the reliability of the connection depends on the unlikelihood of a perfect alignment of the substantially rigid features.

A third class of attachment might be said to combine the property of deformation with the property of precise tolerancing. For example, a straight slot formed in a flexible material may be devised to slightly stretch and recover as a commensurate tab is inserted through it. In this case, reversing the engagement process requires both a conscientious alignment a degree of force.

A fourth class of reversible tag includes an identification surface which is secured by a discrete component such as a strap. The strap may be deliberately designed to be loose relative to the tag, and not integrally formed with the tag, tag bezel or surround. In such a configuration, the tag may be freely turned and read by, for example, a traveler or baggage handler. A tag provided with a loose strap may in practice be exposed to less handling stress, and therefore may survive in situations which might otherwise result in breakage of the strap and baggage loss.

It may be appreciated the there are a variety of structures by which a temporary but reliable connection can be made, and that the choice of such features depends on the materials, the presumed handling environment, and the assumed capabilities of the user.

Within embodiments of the invention, a tag is formed so that it may be at least partially parted from a larger body such as a printed card. The larger body includes a component which is composed and proportioned so that it may readily be formed in a loop and oriented about a target structure such as a luggage handle. Electively, the strap may be made fully separable from the tag, so that it forms a discrete belt-like feature. The strap may then intrude loosely through an opening devised in the tag component, and opposing ends may be linked to one another.

In more specific embodiments of the invention, one or more surfaces are devised to present an optically variable aspect. The distinctiveness and differentiability of the tag may be accentuated by the addition of a surface than varies in color or pattern. Such visual variability may be imparted by various means, as by the preparation and printing of an interlaced image upon the planar back surface of a transparent lenticulated sheet.

Thoughtfully devised variations of the invention also allow for the insertion of the product into publications. In this circumstance, free or loose elongate parts are traditionally forbidden, owing to their tendency to bind and jam industrial printing, binding, labeling, and fulfillment equipment. The invention may therefore serve as a promotional premium in situations in which any prior type of luggage tag would have been prohibited.

Furthermore, the body of a card formed according to the invention may be devised to comply with postal recommendations or requirements. To that end, the parts of the tag assembly may be suitably formed so that they are separable by the postal recipient, but of sufficient structural integrity that the card readily survives automated handling by postal machines. Embodiments of the invention may therefore be used as direct-mail promotions, with or without the complementary appeal of a lenticular effect.

Referring now to FIGS. 1 through 4, plastic card 10 formed of a lenticular material such as amorphous polyethylene (APET) or ethylene glycol polyterephthalate (PETG) has obverse face 40. Obverse face 40 includes a plurality of parallel lenticulations 46, shown schematically in FIG. 3. The lenticules transmit a variable aspect typified by first message phase 42 in FIG. 1 and second message phase 44 in FIG. 2. It may be appreciated by those practiced in the art that the lenticular effect may in practice include twenty or more phases.

It should be understood that although lenticular effect can enhance the appearance and utility of the invention, the invention encompasses embodiments which elect to use materials which do not yield an optically variable effect. Furthermore, it should be understood within the following descriptions of invention that lenticular material has anisitropic bending properties, owing to the relative thinning of the sheet material in the valleys between the lenticules. The flexure of the structural elements may be controlled to some degree by the shape and layout of those features upon the array of lenticules.

Returning now to the drawings, luggage tag 20 is separable from perimeter strap 30 along perforated tag seam 22. Tag 20 includes tag slot 24. Perimeter strap 30 includes connection features typified by tab 32 and slot 34. In the figures, perforated features are indicated by dotted lines. The perforations may be of the type known as microperforations. Microperforations can ensure clean separation of parts, and can leave a relatively appealing edge finish.

It may be understood from the drawings that it may be preferable to leave waste material such as the elliptical feature filling perforated tag slot 24 in place during the mailing or other handling of the product. This choice ensures surface continuity and avoids any unevenness that might cause a mailed item to snag or jam in sorting equipment.

Figure 2:
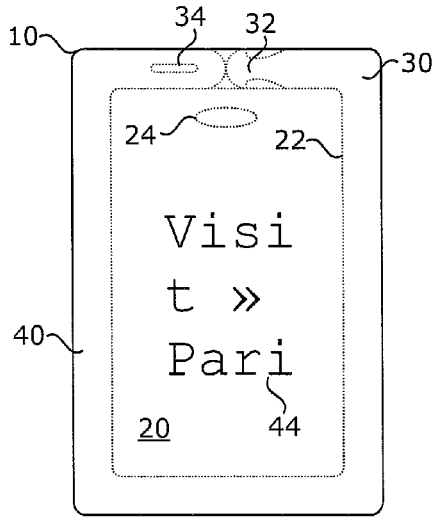
FIG. 2 shows a second view of a lenticular card formed according to the invention.
Figure 3:
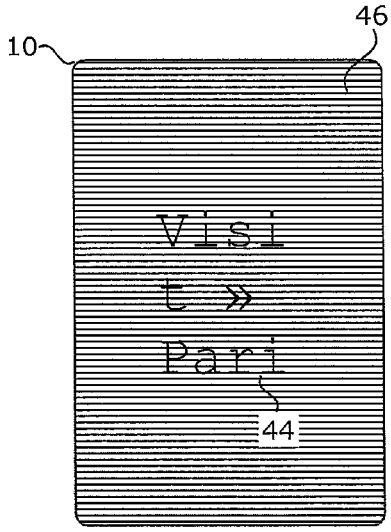
FIG. 3 shows a view of a card formed according to the invention, showing a lenticulated surface.
Figure 4:
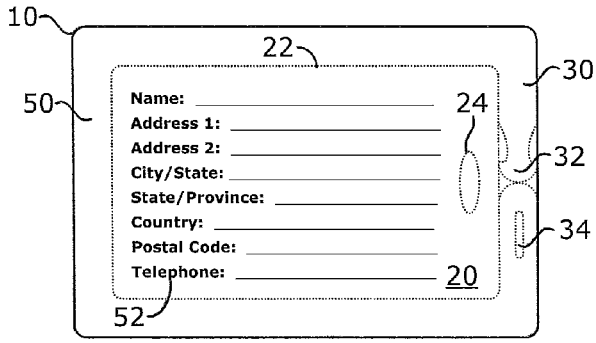
FIG. 4 shows a view of the reverse side of the card depicted in FIGS. 1 through 3 inclusive.

FIG. 4 shows the reverse of the card shown in FIGS. 1 through 3. Reverse surface 50 carries printed indicia suggesting locations for personal data such as a traveler's name and address. The reserve surface 50 at least in the printed indicia area is a writeable surface in that the user can write information, such as personal data, in this area. The reverse face may include a hidden layer carrying a reverse-printed interlaced lenticular image. The interlaced printing may be overprinted with an opaque color such as white, and then may be subject to any further suitable graphical processes. For example, the margins might carry a printed design or embossed pattern, while the open address area might be printed with a special receptive ink such as those used for signature stripes on credit cards. Alternately, the reverse might be coated with a microporous finish in order to make the entire surface receptive to manual or machine writing.

Figure 5:
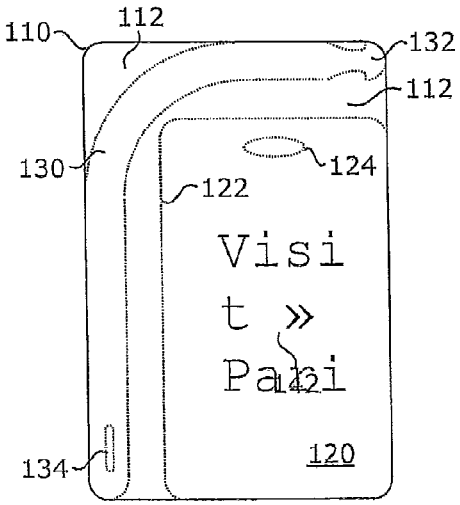
FIG. 5 shows a view of an alternate embodiment of the invention, in which the strap partially surrounds bur does abut the tag component.

FIG. 5 illustrates a variation of the invention in which the strap component is devised to have a single radius rather than the four radii in the prior example. In this case, travel promotion card 110 includes single-bend strap 130 which is provided with slot 134 at one terminus and compatible tab 132 at the other terminus. Breakaway waste 112 is discarded before the card is assembled. Promotion tag 120 is delimited by perforated perimeter 122 and includes perforated strap opening 124. Graphics 142 are visible here on the obverse, but may be either face-printed or reverse-printed.

Figure 6:
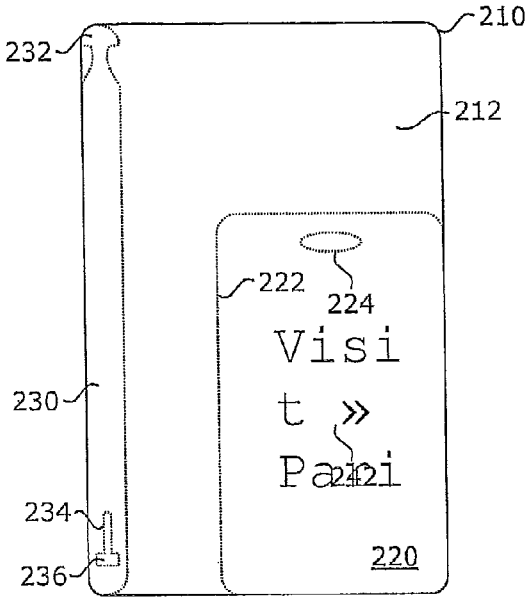
FIG. 6 shows a view of a further embodiment of the invention, in which the strap component is formed parallel to the edge of the card but at a remove from the tag component.

FIG. 6 shows a further variation of the invention in which the strap is substantially straight and parallels the long axis of the tag. Promotional mailer 210 includes ephemeral area 212, which may be used, for example, to carry for advertising, information, or instructions. Mailer tag 220 can be broken away from one corner of the mailer and about perimeter 222, while straight strap 230 may be readily separated from one edge. Tab 232 may optionally be used as a tool to remove waste from perforated tab opening 224.

In FIG. 6, slot 234 is depicted with long slot 234 and contiguous T-slot 236, so that tab 232 may be inserted edgewise into the long portion and rotated so that the neck of the tab is reliably retained by T-slot 236. This locking feature is intended to be representative, and in the practice of the invention may be embodied in diverse geometrical configurations.

Figure 7:
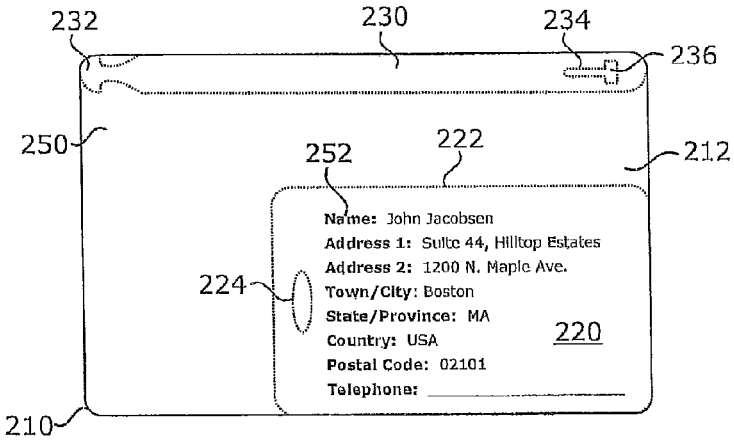
FIG. 7 shows the reverse side of the card shown in FIG. 6, showing the option of using the posting address as preprinted data for the luggage card.

FIG. 7 illustrates the reverse of the mailer shown in FIG. 6 and demonstrates a variation of the invention in which the recipient's name and mailing address 252 serve a secondary function as a preprinted luggage tag. In this embodiment, the addressee receives the mailer which may include, for example, a promotion for an event, destination, hotel, flight, vacation package, or frequent-flier program. The separable tag and strap may be combined to form an attractively finished and highly readable luggage tag.

Figure 8:
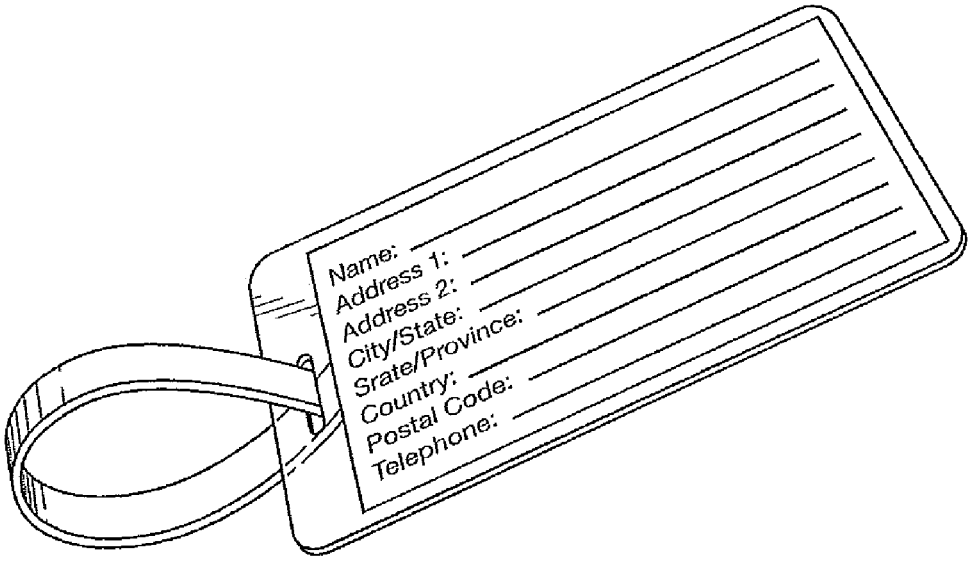
FIG. 8 shows a view of an assembled luggage tag formed according to the invention.

The preprinted property provides an opportunity for dual service, but does not require that the tag's surface serve as the mailing address. Any of the embodiments shown may be combined or modified in diverse ways. For example, FIG. 8 shows a perspective view of the using the card structure illustrated in FIGS. 6 and 7, but which carries the blank data form shown in FIG. 4. The perspective view shows the tab inserted through tab opening 224 and locked to into the T-slot in the strap's opposite end.

The intended scope of the invention includes many more variations than can be shown here. For example, a mailer can include two or more tags with compatible fastening means. The shape and design of the strap and the tags can vary greatly without departing from the spirit of the invention. The graphics can be freely designed, and the base material can be clear, colored white, a lenticular array, or a combination of such materials. The base material may be paper, nonwoven polymer fiber sheet, plastic film or sheet stock, or any layering, lamination, or fusion of such materials.

What is claimed is:

1. A perforated card including a plurality of separable components comprising:

a substrate including:

a tag suitable for the inclusion of personal data such as an address, the tag including at least two intersecting sides and an opening and a perimeter edge; and a strap that is completely separable from the tag along a defined perforation, the strap being directly attached to at least a portion of the tag, the strap being insertable through the opening of the tag, the strap being configured to be fixedly attached about a handle of a piece of luggage, wherein the strap is directly attached to the perimeter edge of the tag and extends along a substantial length of the tag including extending completely along the first and second sides, wherein the strap defines at least one outer side edge of the substrate.

2. The card of claim 1, wherein the card is formed of a lenticular material.

3. The card of claim 2, wherein an obverse side of the card includes a plurality of parallel lenticulations and a reverse side of the card includes the personal data.

4. The card of claim 1 wherein the strap at least substantially surrounds the tag.

5. The card of claim 1 wherein the strap includes an opening formed at a first end and a tab formed at an opposite second end for receipt through the opening formed in the strap.

6. The card of claim 4, wherein the strap has a rectangular shape when attached to the tag along perforations.

7. A perforated card including a plurality of separable components comprising:

a substrate including first and second sides that intersect one another and define one corner of the substrate, the substrate including:

a separable tag suitable for the inclusion of personal data such as an address, the tag including an opening; and a strap that is completely separable from the tag along a defined perforation and is insertable through the opening of the tag, the strap being configured to be fixedly attached about a handle of a piece of luggage;

wherein the strap extends along and defines a length of the first and second sides of the substrate such that portions of the strap define an outer peripheral edge of each of the first and second sides of the substrate so as to define at outermost edge of the card.

8. The card of claim 7, wherein the substrate includes a breakaway waste portion disposed between the tag and the strap that is separable therefrom.

9. The card of claim 7, wherein the substrate includes an ephemeral area disposed between the tag and the strap, the ephemeral area for displaying indicia.

10. The card of claim 9, wherein the tag and strap are attached to the ephemeral area along perforations.

11. The card of claim 7, wherein the strap and tag are attached to the substrate about a curve with one end of the strap being in a first corner of the substrate and the other end of the strap being in a second corner of the substrate opposite the first corner.

12. The card of claim 7, wherein the strap includes a T-shaped slot formed at one end and a tab at an opposite end for reception through the T-shaped slot for attaching the strap to one another, wherein the T-shaped slot is formed of a first section that is in the form of a leg defined by spaced apart edges to define a first opening and a second section that is formed perpendicular to the first section and is defined by spaced apart edges to define a second opening, the first and second openings being always open prior to reception of the tab.

13. The card of claim 7, wherein the card is formed of a lenticular material.

14. The card of claim 13, wherein an obverse side of the card includes a plurality of parallel lenticulations and a reverse side of the card includes the personal data.

15. The card of claim 1, wherein the strap is directly attached to and extends around substantially the entire perimeter edge of the tag.

16. The card of claim 1, wherein the tag has a rectangular shape and includes four sides and the strap is directly attached to and extends along all four sides of the tag and the strap defines a complete perimeter outer edge of the substrate.

17. The card of claim 1, wherein opposing free ends of the strap are located along one side of the tag.

18. The card of claim 7, wherein a length of the second side is shorter than the first side and a length of the strap along the second side is less than a length of the strap of the strap along the first side.

19. The card of claim 18, wherein one free end of the strap defines one corner of the substrate and another free end of the strap defines an opposite corner of the substrate.

20. The card of claim 19, wherein the one free end is diagonally opposite the other free end.

* * * * *